US012138676B2

(12) United States Patent
Venkata Reddy et al.

(10) Patent No.: US 12,138,676 B2
(45) Date of Patent: Nov. 12, 2024

(54) SYSTEM FOR A SHEET METALWORKING AND A PROCESS THEREOF

(71) Applicants: INDIAN INSTITUTE OF TECHNOLOGY HYDERABAD (IITH), Sangareddy (IN); TATA STEEL LIMITED, Jharkhand (IN)

(72) Inventors: Nallagundla Venkata Reddy, Hyderabad (IN); Adabala Subrahmanyam, Hyderabad (IN); Gangavenkataiah Ramu, Hyderabad (IN); Rahul Kumar Verma, Jamshedpur (IN); Dasu Venkat Raju, Jamshedpur (IN); Suman Guha, Jamshedpur (IN)

(73) Assignees: INDIAN INSTITUTE OF TECHNOLOGY HYDERABAD (IITH), Kandi (IN); TATA STEEL LIMITED, Jamshedpur (IN)

( * ) Notice: Subject to any disclaimer, the term of this patent is extended or adjusted under 35 U.S.C. 154(b) by 515 days.

(21) Appl. No.: 17/434,688

(22) PCT Filed: Feb. 28, 2020

(86) PCT No.: PCT/IB2020/051713
§ 371 (c)(1),
(2) Date: Aug. 27, 2021

(87) PCT Pub. No.: WO2020/174450
PCT Pub. Date: Sep. 3, 2020

(65) Prior Publication Data

US 2023/0067089 A1 Mar. 2, 2023

(30) Foreign Application Priority Data

Feb. 28, 2019 (IN) ..... 201941008005

(51) Int. Cl.
*B21D 5/00* (2006.01)
*B21D 5/02* (2006.01)
*B21D 22/02* (2006.01)

(52) U.S. Cl.
CPC ..... *B21D 5/008* (2013.01); *B21D 5/0209* (2013.01); *B21D 5/0281* (2013.01); *B21D 22/022* (2013.01)

(58) Field of Classification Search
CPC .... B21D 5/008; B21D 5/0209; B21D 5/0281; B21D 22/022; B21D 22/208
See application file for complete search history.

(56) References Cited

U.S. PATENT DOCUMENTS 1,251,578 A * 1/1918 Riecken ..... B21D 5/008 219/149
4,532,793 A * 8/1985 Bezold ..... B21D 22/208 72/347

(Continued)

FOREIGN PATENT DOCUMENTS

CN 108405727 A * 8/2018 ..... B21D 37/10
JP H07155856 A * 6/1995

OTHER PUBLICATIONS

International Searching Authority, "International Search Report," issued in connection with International Patent Application No. PCT/IB2020/051713, dated Sep. 11, 2020.

(Continued)

*Primary Examiner* — Jared O Brown
(74) *Attorney, Agent, or Firm* — Foley & Lardner LLP

(57) ABSTRACT

A system (100) for sheet metalworking comprising a punch (1) connectable to a press (P), wherein the punch (1) is configured with a first electrical terminal (2). A die (3) configured with a die surface (DS), to support sheet metal (SM). A support member (4) movably disposed in the die (1), the support member (4) is provided with a second (Continued)

electrical terminal (5). The support member (4) and the punch (1) contacts a working portion (B) of the sheet metal (SM) at an axis (A-A) to supply electric current to a localized region (LR) of the working portion (B) for sheet metalworking.

16 Claims, 6 Drawing Sheets

(56) References Cited

U.S. PATENT DOCUMENTS 6,209,381 B1 * 4/2001 Yaguchi ..... B21D 28/22 72/335
7,302,821 B1 * 12/2007 Dariavach ..... B21D 22/02 72/364

OTHER PUBLICATIONS

International Searching Authority, "Written Opinion," issued in connection with International Patent Application No. PCT/IB2020/051713, dated Sep. 11, 2020.

* cited by examiner

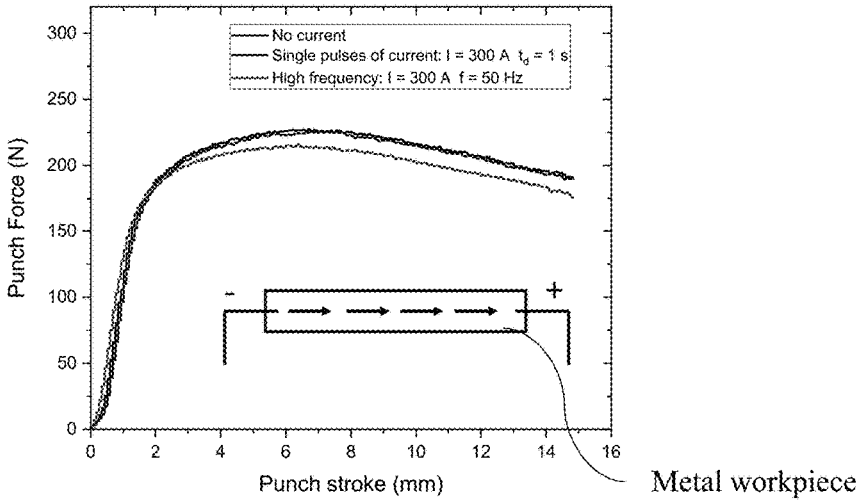
Figure 10 [Prior art]
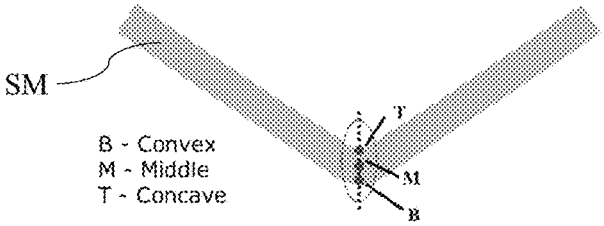
Figure 11(a)
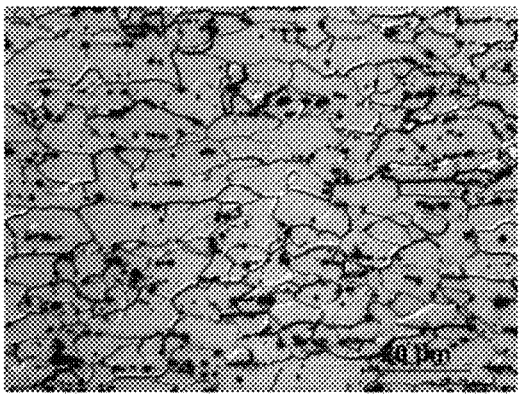
Figure 11(b)
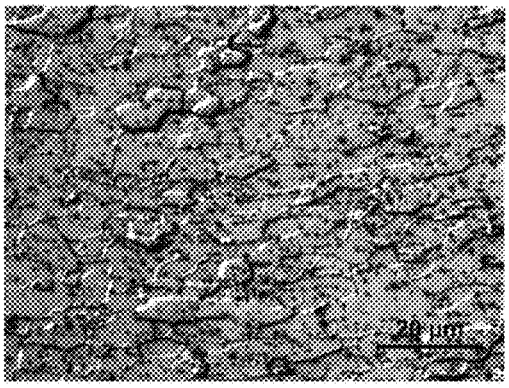
Figure 11(c)
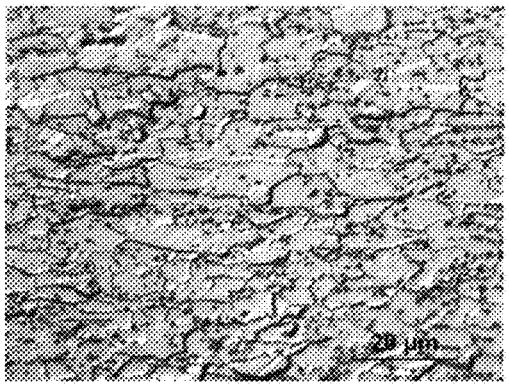
Figure 11(d)

SYSTEM FOR A SHEET METALWORKING AND A PROCESS THEREOF

CROSS-REFERENCE TO RELATED APPLICATIONS

The present application claims priority under 37 U.S.C. § 371 to International Patent Application No. PCT/IB2020/051713, filed Feb. 28, 2020, which claims priority to and the benefit of Indian patent application No. 201941008005, filed on Feb. 28, 2019. The contents of these applications are hereby incorporated by reference in their entireties.

TECHNICAL FIELD

Present disclosure generally relates to a field of manufacturing technology. Particularly, but not exclusively the present disclosure relates to a system and process for sheet metalworking. Further, embodiments of the disclosure disclose a system and process for supplying electric current to a localized portion of the sheet metal during sheet metalworking.

BACKGROUND OF THE DISCLOSURE

Manufacturing industries utilize various manufacturing processes for working of various materials. Electrically assisted manufacturing (EAM) process is one such process which falls in to the category of advanced manufacturing processes. During manufacturing, some materials have different physiological properties, and these physiological properties may be altered due to various parameters such as temperature, stress, strain etc during metalworking. Moreover, automotive industry requires different materials with innovative metalworking processes in order to meet the ever changing requirements of the automotive industry. Conventionally, several metalworking techniques such as hot forming and hydroforming provides a wide range of advantages for metalworking. However, these technologies require huge capital investments. Moreover, such technologically advanced installations have several process related issues and are time consuming.

Generally, electrically assisted forming or manufacturing is an alternative metalworking process that includes application of high-density electric pulses during metalworking. Application of electric pulses during metalworking reduces working loads and also spring-back in the metal or workpiece. This phenomenon of reduction in working loads due to the application of electric pulses is known as "electroplastic effect".

Conventionally, usage of such electric pulses in metalworking processes is well known. Such a manufacturing process involves application of high density electric current pulses throughout length of the metal workpiece [as shown in FIG. 10]. From the FIG. 10, which discloses the conventional process of metalworking, the metal workpiece is connected with electrical terminals wherein electrical current is passed throughout the length of the metal workpiece. Even though this technique reduces the working loads but drastically increases the temperature of the metal workpiece due to joule heating. Joule heating causes some of the problems such as alteration of physiological properties of the metal that has been worked, which may result in undesirable metalworking results. Especially in the automotive industry, sheet metalworking is a major and important process which requires utmost precision and care. Therefore, direct use of electric current pulses for sheet metalworking ultimately increases the overall temperature of the sheet metal, which may not be desirable.

Moreover, if any material or the metal workpiece is subjected to electric current pulses, a higher resistance of the workpiece exists which ultimately results in supply of higher electric power for metalworking. This results in a much more expensive metalworking process. Further, as the supply of electric current increases for metalworking, a need for larger thermal insulation may be required in order to maintain or render safe working environment.

The present disclosure is directed to address one or more problems as discussed above.

The information disclosed in this background of the disclosure section is only for enhancement of understanding of the general background of the invention and should not be taken as an acknowledgement or any form of suggestion that this information forms the prior art already known to a person skilled in the art.

SUMMARY OF THE DISCLOSURE

One or more drawbacks of conventional system for sheet metal working by passing electric current is overcome, and additional advantages are provided through a process as claimed in the present disclosure. Additional features and advantages are realized through the technicalities of the present disclosure. Other embodiments and aspects of the disclosure are described in detail herein and are considered to be a part of the claimed disclosure.

In one non-limiting embodiment of the present disclosure, a system for sheet metalworking is disclosed. The system comprising a punch connectable to a press, wherein the punch is configured with a first electrical terminal. A die configured with a die surface is provided in the system, to support sheet metal. A support member is movably disposed in the die. The support member is provided with a second electrical terminal. The support member and the punch contacts a working portion of the sheet metal at an axis to supply electric current to a localized region of the working portion for sheet metalworking.

In an embodiment, the localized region is defined by a contact portion of a tip end of the punch and the tip end of the support member on either sides of the sheet metal.

In an embodiment, the electric current passes from the tip end of the punch and the tip end of the support member to the localized region of the working portion on either sides of the sheet metal.

In an embodiment, the press comprises a punch holder for housing the punch.

In an embodiment, the system comprises an insulation layer in-between the punch holder and the punch to prevent electric conductance.

In an embodiment, the support member displaces within the die along the axis when the punch is operated from a first position to a second position for sheet metalworking.

In an embodiment, the support member at the first position, is in contact at the working portion of the sheet metal before the sheet metalworking.

In an embodiment, the support member maintains the contact with the working portion of the sheet metal in the second position.

In an embodiment, the support member is biased by a resilient member.

In an embodiment, the resilient member is a spring.

In an embodiment, the die comprises a slot for accommodating reciprocal motion of the support member between the first position and the second position.

In an embodiment, an insulation strips provided in-between the support member and the at least one second electrical terminal to prevent electric conductance.

In an embodiment, each of the first electrical terminal and the second electrical terminal is connected to at least one of a positive and a negative terminal of a power source.

In an embodiment, the punch is configured with varying tip diameters for sheet metalworking.

In an embodiment, the sheet metalworking is a plastic deformation process.

In an embodiment, an adapter configured to house at least one load cell for determining load applied on the punch.

In an embodiment, the adapter with the at least one load cell, is secured to the press.

In another non-limiting embodiment, a process for sheet metalworking is disclosed. The process comprises positioning a sheet metal over a die surface of a die. A working portion of the sheet metal contacts a second electrical terminal configured in a support member movably disposed in the die. Operating a punch configured with a first electrical terminal to contact the working portion of the sheet metal, at an axis. Supplying the electric current to the working portion of the sheet metal through the first and second electrical contacts for sheet metalworking.

In an embodiment, supplying the electric current at the working portion aids in sheet metalworking.

In an embodiment, the electric current supplied to the sheet metal has a high current range and a high frequency range.

In an embodiment, the frequency range of the electric current supplied is in the range of 1 Hz to 50 Hz.

In an embodiment, the electric current supplied is in the range of 0 A to 300 A. In an embodiment, the electric current is supplied in pulses to the sheet metal.

In an embodiment, pulses of electric current are supplied by a pulse width modulator (PWM).

It is to be understood that the aspects and embodiments of the disclosure described above may be used in any combination with each other. Several of the aspects and embodiments may be combined to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The novel features and characteristics of the disclosure are set forth in the appended description. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

FIG. 10 illustrates a graph showing application of current and current flow in the working portion of the sheet metal, in accordance with the conventional method of application of electric pulsing.

FIGS. 11(*a*), 11(*b*), 11(*c*), and 11(*d*) illustrates metalworking at the working portion of the sheet metal and microstructural study at the working portion of the sheet metal, in accordance with an embodiment of the present disclosure.

Figure 12:
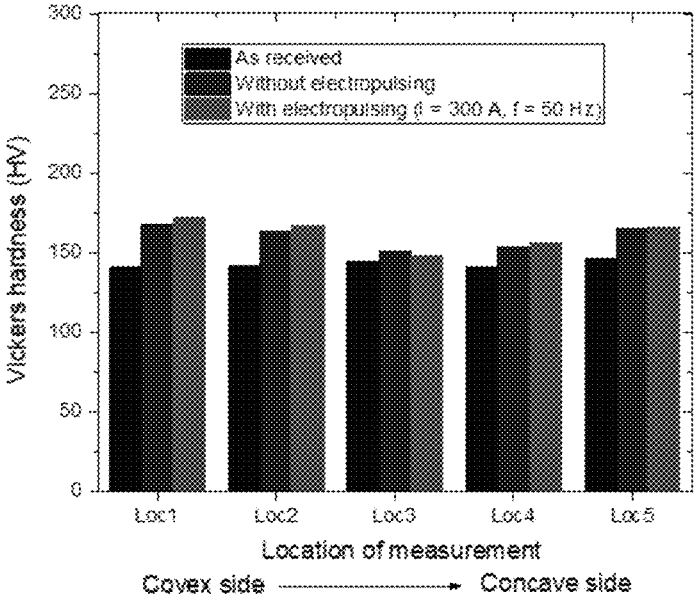

FIG. 12 illustrates a bar chart of hardness due to electropulsing in accordance with an embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE DISCLOSURE

While the embodiments of the disclosure are subjected to various modifications and alternative forms, specific embodiment thereof have been shown by way of example in the figures and will be described below. It should be understood, however, that it is not intended to limit the disclosure to the particular forms disclosed, but on the contrary, the disclosure is to cover all modifications, equivalents, and alternative falling within the scope of the disclosure.

It is to be noted that a person skilled in the art would be motivated from the present disclosure to arrive at a system and process of sheet metal working. The system and process for sheet metalworking that is disclosed may vary based on configuration of the sheet metal. However, such modifications should be construed within the scope of the disclosure.

Accordingly, the drawings illustrate only those specific details that are pertinent to understand the embodiments of the present disclosure, so as not to obscure the disclosure with details that will be clear to those of ordinary skill in the art having benefit of the description herein.

The terms "comprises", "comprising", or any other variations thereof used in the disclosure, are intended to cover a non-exclusive inclusion, such that a device, system, assembly that comprises a list of components does not include only those components but may include other components not expressly listed or inherent to such system, or assembly, or device. In other words, one or more elements in a system or device proceeded by "comprises . . . a" does not, without more constraints, preclude the existence of other elements or additional elements in the system or device.

The present disclosure provides a system for sheet metalworking. The system comprises a punch that is connectable to a press. The punch is positioned over a die, wherein the die receives the sheet metal for metalworking. The die is also provided with a support member such that, upon receiving the sheet metal, the support member contacts the sheet metal at a working portion. Similarly, a tip end of the punch also contacts the sheet metal at the working portion along a common axis. A first electrical terminal is configured in the punch and a second electrical terminal is connected to the support member. As the press is operated, the punch may be displaced over the sheet metal and comes in contact on the sheet metal at the working portion. At this position, the first electrical terminals and the second electrical terminals are passed with pulsed electric current, and the electric current passes through the sheet metal at the working portion. This aids in metalworking of the sheet metal by reducing the load required for metalworking and also reduces joule heating as the electric current is passed at a localized working portion of the sheet metal.

The present disclosure also provides a process for sheet metalworking. The process includes positioning of the sheet metal over a die such that the working portion of the sheet metal contacts the support member. The sheet metal at a localized region of the working portion is contacted by the tip portion of the punch and the support member along a common axis. The support member is configured to displace upon movement of the sheet metal due to the working of the punch on the sheet metal. As the punch and the support member are provided with first electrical terminal and the second electrical terminal, electric current is passed in pulses, through the working portion in order to perform sheet metalworking. This configuration of the system and process for sheet metalworking reduces joule heating as the electric current is passed at the localized region such as the working portion of the sheet metal rather than the entire length of the sheet metal.

The present disclosure discloses a system and process for metalworking by mitigating heat generated within the sheet metal during metalworking. Also, this process of sheet metalworking is versatile and may use less load for metalworking, while being time efficient and economical. The system and process of the present disclosure also eliminates the need for expensive equipment for sheet metalworking.

The following paragraphs describe the present disclosure with reference to FIGS. 1 to 11(*d*). In the figures, the same element or elements which have similar functions are indicated by the same reference signs.

Figure 1:
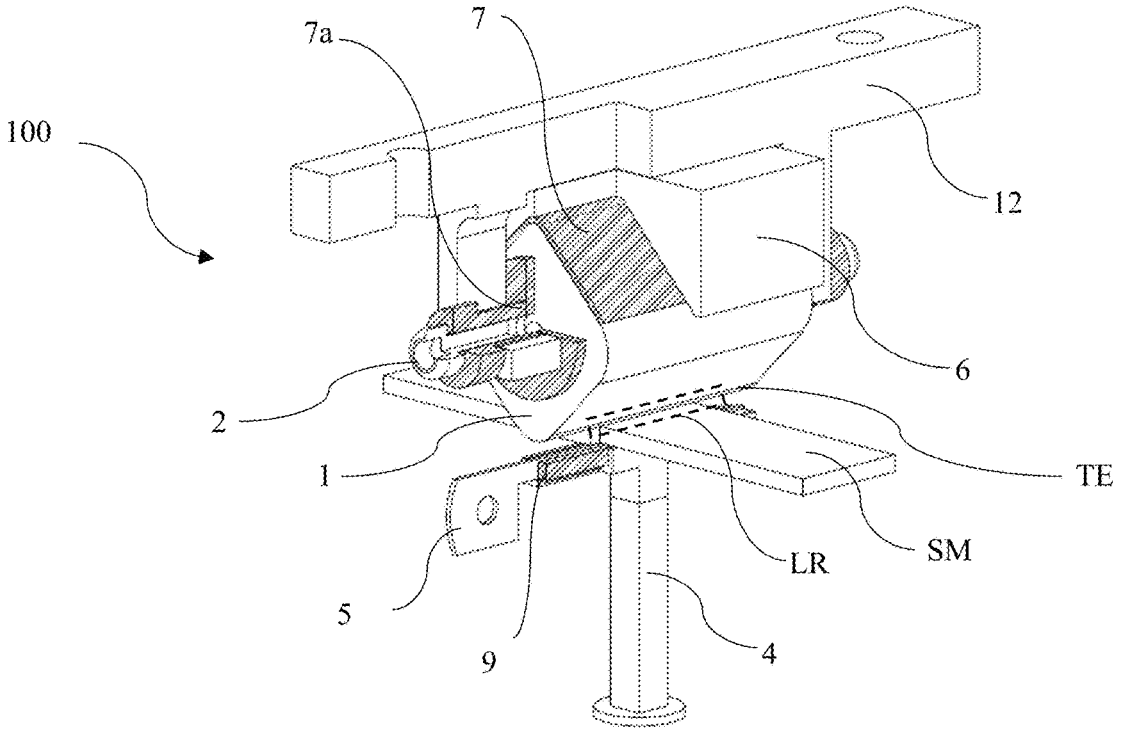
FIG. 1 illustrates a schematic perspective view of a system for sheet metalworking, in accordance with an embodiment of the present disclosure.
Figure 2:
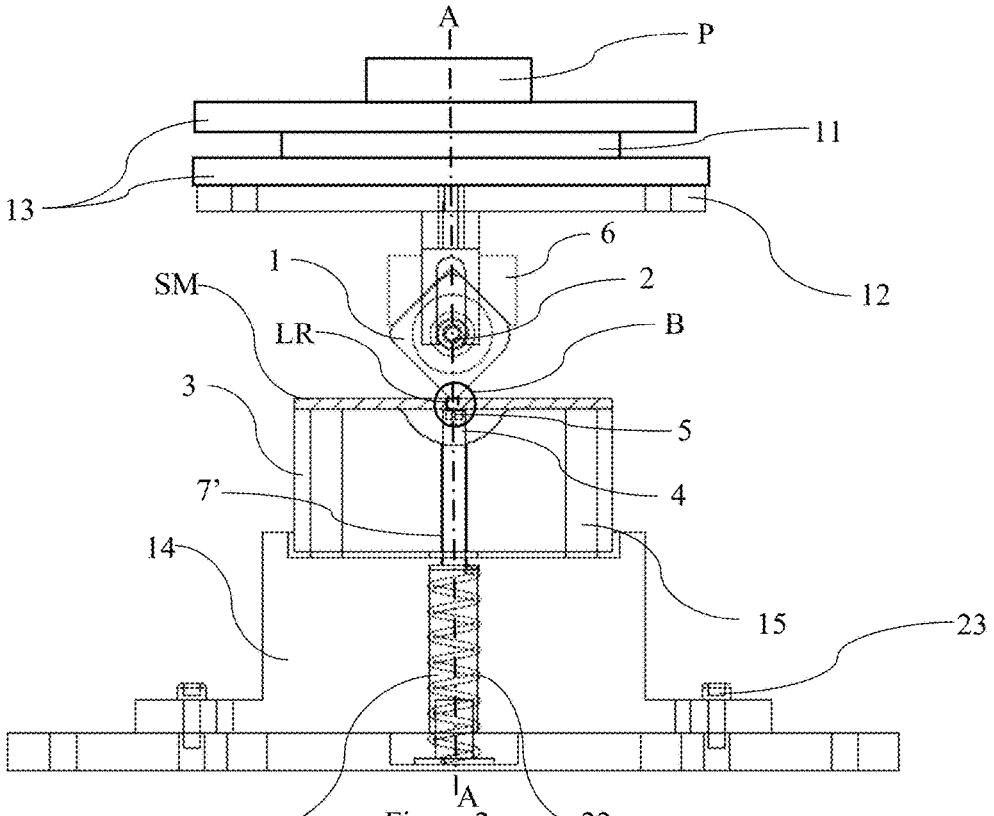
FIG. 2 illustrates sectional front view of the system with a sheet metal provided over a die for sheet metalworking, in accordance with an embodiment of the present disclosure.

FIG. 1 is an exemplary embodiment of the present disclosure which illustrates a perspective view of a system (100) for sheet metalworking.

The system (100) comprises a punch (1) (shown in FIG. 5) mountable to a press (P). The press (P) comprises a load cell plate (13), wherein load cell plate (13) may be provided on either sides of the at least one load cell (11). The at least one load cell (11) is housed between the load cell plates (13). Further, the load cell plate (13) may be connected to an adapter (12) for housing a tool [i.e. the punch (1)]. The punch (1) is seated within a punch holder (6), wherein the punch holder (6) is connected to the adapter (12). In an embodiment, the punch (1) may be configured with varying tip end radii for varying punch radii while working on the sheet metal. The punch (1) is further configured with a first electrical terminal (2), such that the first electrical terminal (2) is connected to one of the terminals of a power source (10). Further, the system (100) comprises a die (3) positioned below the punch (1). The die (3) may be further mounted on to a die holder (14) which may be fastened to a support member (4) by the use of plurality of fasteners (23). The die (3) is further defined with mounting holes (16) in order to receive plurality of insulated rods (15) from the die holder (14) for mounting. The die (3) comprises a die surface (DS) [i.e. top face of the die (3)] for supporting a sheet metal (SM). In an embodiment, the die surface (DS) may be provided with plurality of fillets (17) in order to support metalworking, such as a bending operation of the sheet metal during metalworking. A support member (4) is disposed in the die (3), wherein the support member (4) is movable within a slot (8) defined in the die (3). The support member (4) is biased by a resilient member (22) which is provided within the slot (8) in the die (3). In an embodiment, the support member (4) is configured to move within the slot (8) in a longitudinal manner based on the operation of the punch (1) on the sheet metal. The resilient member (22) may be at least one of a spring or a polymeric damper, or any other resilient member (22) that serves the purpose of providing resilient force to the support member (4) during metalworking operation of the sheet metal (SM).

In an embodiment, the support member (4) is configured with a second electrical terminal (5), and the second electrical terminal (5) is connected another terminal of the power source (10). A tip end (TE) of the support member (4) is in contact with the sheet metal (SM) provided on the die (3). As the press (P) is operated, the punch (1) with its tip end (TE) comes in contact with the sheet metal (SM) at a localized region (LR) of a working portion (B) of the sheet metal (SM). As the sheet metal (SM) is subjected to metalworking, the tip ends (TE) of the punch (1) and the support member (4) contacts the localized region (LR) of the working portion (B) along an axis (A-A) on either sides of the sheet metal (SM). Also, as the sheet metal (SM) is worked by the punch (1) provided over the die (3), and the support member (4) is always in moving contact with the sheet metal (SM) during metalworking. In an embodiment, the first electrical terminal (2) may be connected to a positive pole of the power source (10) and the second electrical terminal (5) may be connected to a negative pole of the power source (10). In an embodiment, the polarity of the first electrical terminal (2) and the second electrical terminal (5) may be interchanged which is connected to the power source (10).

In an embodiment, as the punch (1) presses down on the sheet metal (SM) on operation of the punch (P), the first electrical terminal (2) and the second electrical terminal (5) receives electric current in the form of pulses from the power source (10). This electric current is concentrated only at the localized region (LR) of the working portion (B) of the sheet metal (SM) and the electric current is localized only at the axis (A-A). In an embodiment, the point of contact for the tip end (TE) of the punch (1) and the tip end (TE) of the support member (4) is at the location where the sheet metal (SM) to be worked. In an example, during bending operation of the sheet metal (SM), the working portion (B) is formed at a V-bend portion of the sheet metal (SM). Moreover, the electric current supplied during metalworking [bending process] passes between the first electrical terminal (2) to the second electrical terminal (5) or vice versa only at the localized region (LR) of the working portion (B) of the sheet metal (SM).

In an embodiment, the passage of electric current may be restricted only to the localized region (LR) of the working portion (B) of the sheet metal (SM). As the punch (1), bends the sheet metal into the die (3), pulsed electric current may be supplied from each of the first electrical terminal (2) and the second electrical terminal (5) from the power source (10). As the load is applied on the press (P), the at least one load cell (11) determines the amount of load being applied on the sheet metal (SM) at any particular interval of metalworking. In an embodiment, the at least one load cell (11) is at least one of a strain gauge based transducer or any other load cell that aids in determination of the load applied on the punch (1).

Figure 3:
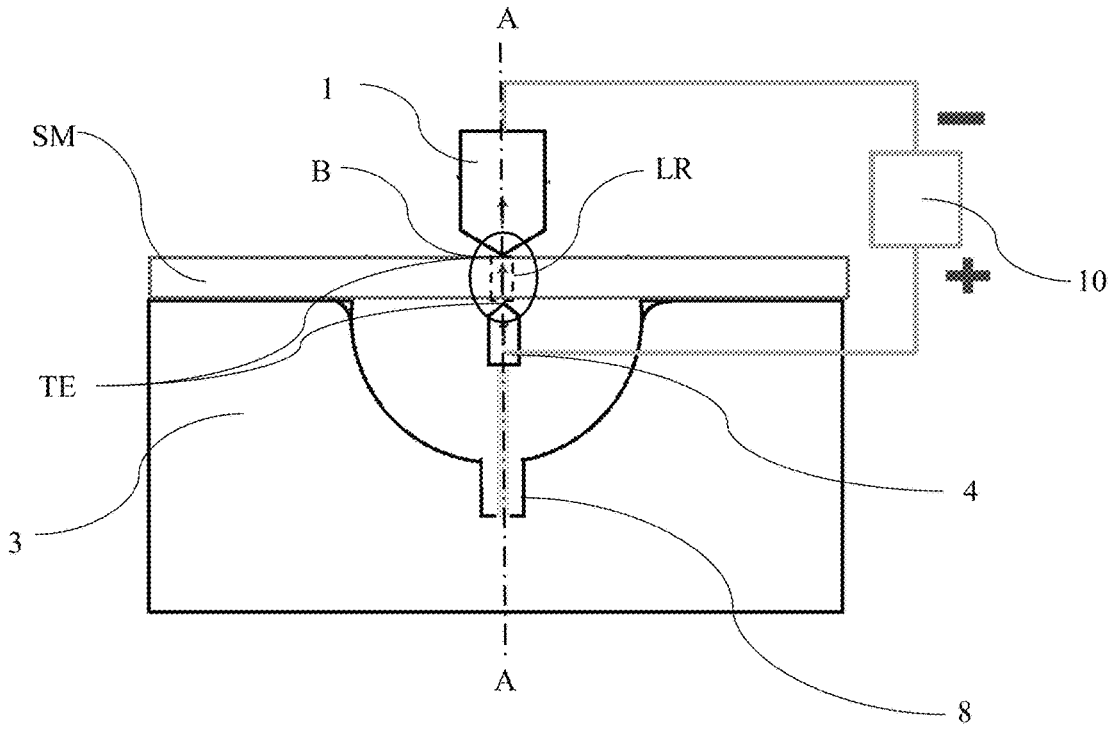
FIG. 3 illustrates schematic view showing passage of electric current pulses through the sheet metal, in accordance with an embodiment of the present disclosure.
Figure 4:
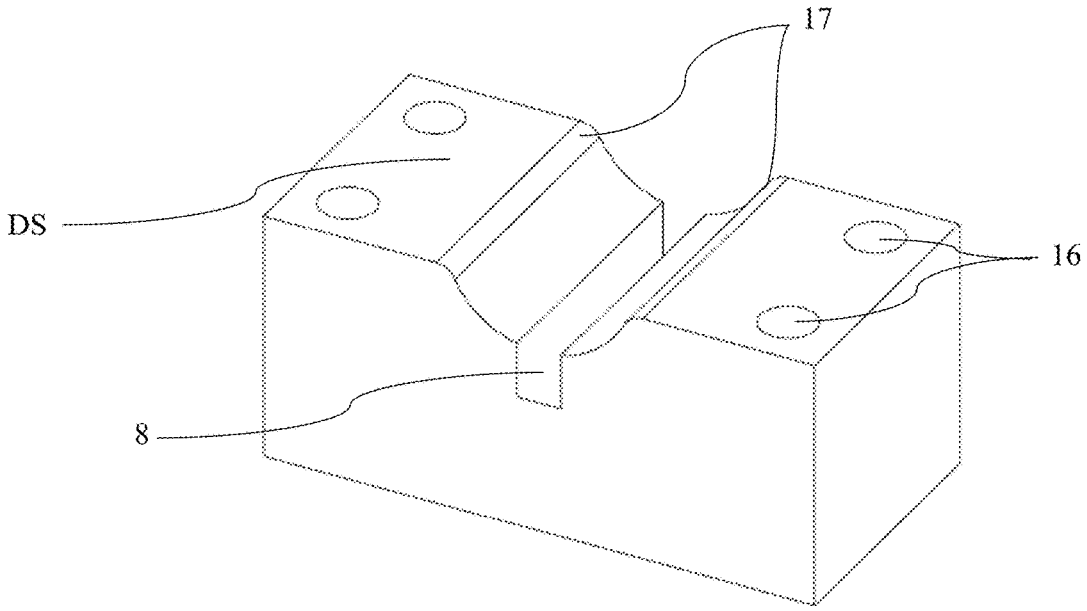
FIG. 4 illustrates perspective view of the die used in the system of FIG. 1, in accordance with an embodiment of the present disclosure.

Referring to FIG. 3, the system (100) includes the punch (1) with its tip end (TE) contacting the sheet metal (SM) at the working portion. Similarly, the support member (4) provided in the die (3) with its tip end (TE) is in contact with the sheet metal (SM) at the working portion (B). In an embodiment, the electric current may be supplied from a programmable DC power source (10). The DC power source (10) may be further connected to a pulse generator such as a pulse width modulator (18) in order to supply continuous electric current pulses to the first electrical terminal (2) and the second electrical terminal (5). From the FIG. 3, it is clear that the electric current is passed through the sheet metal (SM) at the localized region (LR) of the working portion (B), rather than the entire length of the sheet metal (SM). FIG. 3 illustrates, a magnified view of the tip end (TE) of the punch (1) that is in contact with the sheet metal (SM) at the working portion (B). Similarly, the tip end (TE) of the support member (4) is also in contact with the sheet metal (SM) along a common axis (A-A).

In an embodiment, the die (3) defined with the slot (8) houses the support member (4). The slot (8) may be provided with an insulation layer (7') similar to the insulation layer (7) provided in-between the punch (1) and the punch holder (6), in order to prevent leakage of the electric current passing through the support member (4) into the die (3). In an embodiment, the second electrical terminal (5) is provided such that, the electrical current passes only through the tip end (TE) portion of the support member (4) and into the sheet metal (SM) at the working portion (B). In an embodiment, the slot (8) defined in the die (3) may be at least one of a square shaped slot (8), a rectangular slot (8) to house the resilient member (22) and the support member (4). During operation of the punch (1) on the sheet metal (SM), the punch (1) deforms or bends the sheet metal (SM) into V-shape form, wherein this bending or deformation of the sheet metal (SM) may be supported by the plurality of fillets (17) defined on the die (3) surface.

Figure 5:
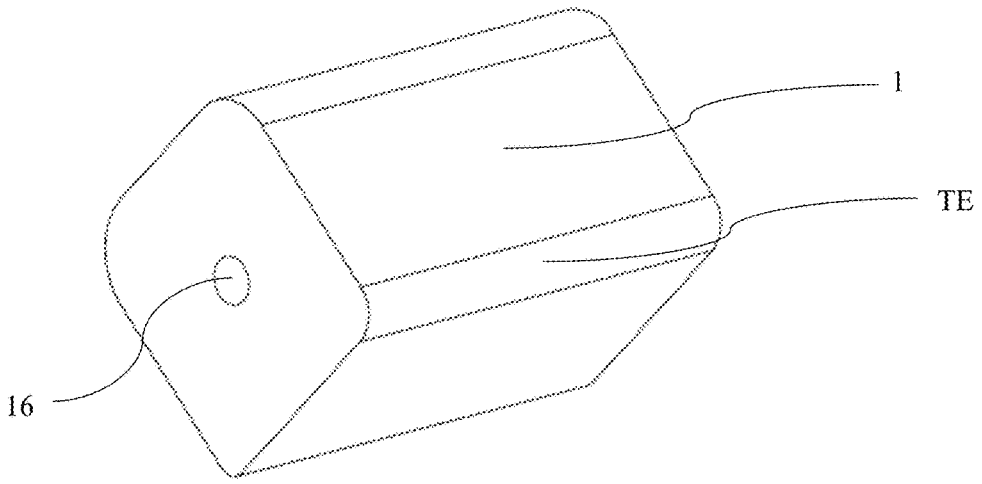
FIG. 5 illustrates perspective view of the punch used in the system of FIG. 1, in accordance with an embodiment of the present disclosure.

In an embodiment, the punch (1) fixed to the punch holder (6) comprises of plurality of varying tip radii [best shown in FIG. 5]. Further, the punch (1) is fixed to the punch holder (6) with an intermediate insulation layer (7) between them in order to prevent leakage of current from the first electrical terminal (2) to the punch holder (6). In an embodiment, varying tip radii of the punch (1) may be used to perform desired metalworking operations on the sheet metal (SM). The varying tip radii of the punch (1) ranges from 2 mm to 12 mm based on the requirement. The varying tip radii are only aspects and embodiments disclosed herein are for purposes of illustration and are not intended to be limiting not should be considered as limiting. As an example, if the sheet metal (SM) needs to be bend at a desired radius, then the punch (1) with the desired radii may be used by changing the position of the punch (1) within the punch (1) holder to suit the requirement.

In an embodiment, the first electrical terminal (2) connected to the punch (1) is provided with insulation, wherein the insulation is in the form of bush and washer (7*a*). The insulation bush and washer (7*a*) prevents any leakage of electric current passing through the first electrical terminal (2) into the adapter (12). A mounting hole (16) is defined on the die (3) in order to receive the insulation rods (15). In an embodiment, the insulation layer (7, 7'), the insulation strips (9) and the insulation bush and washer (7*a*) may be made of bakelite, elastomers or any electrically insulating material which serves the purpose of preventing electrical conductance or leakage of electric current.

Figure 6:
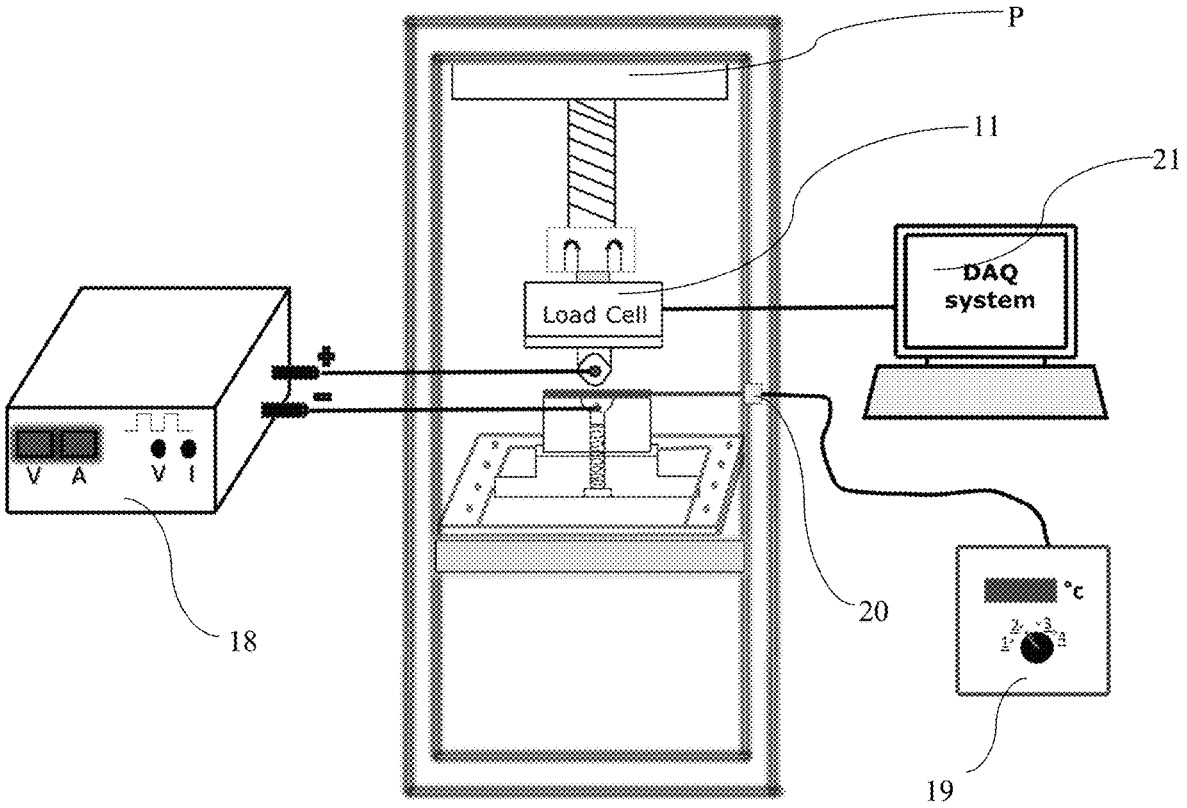
FIG. 6 illustrates an experimental system for sheet metalworking installed with peripheral various test instruments, in accordance with an embodiment of the present disclosure.
Figure 7:
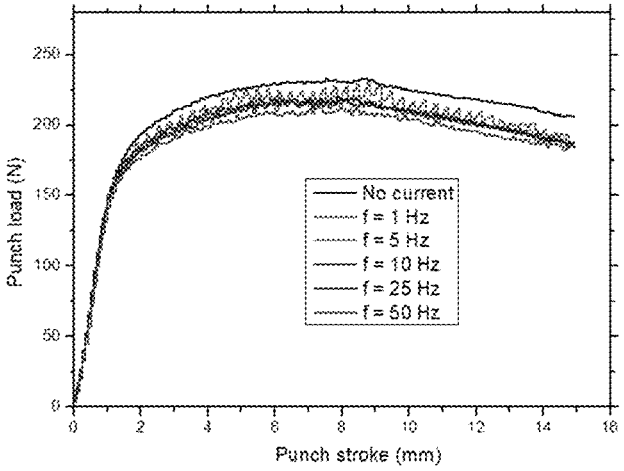
FIG. 7 illustrates a graph showing effect of frequency on the punch load at 300 A current, in accordance with an embodiment of the present disclosure.

Referring to FIG. 6, the system (100) for sheet metalworking is disclosed. The system (100) in one embodiment is a test system (100) provided with plurality of peripheral test instruments such as data acquisition system (21), temperature indicators (19) and pulse width modulators (18). The data acquisition system (21) is connected to the at least one lad cell (11). The data acquisition system (21) acquires critical load parameters data for each metalworking process. Further, the system (100) is provided with the temperature indicator (19), wherein the temperature indicator (19) is connected to a thermocouple (20) fixed to the sheet metal (SM). As the electric current is passed at the working portion (B) of the sheet metal (SM), the temperature increase may be determined by the thermocouple (20) and indicated to a user by the temperature indicator (19). In an embodiment, the temperature indicator (19) may be programmed to display various temperature parameters of the sheet metal (SM) that is undergoing metalworking. The temperature indicator (19) is at least one of a digital display indicator or analog display indicator or any other temperature indicator (19) that serves the purpose.

In an embodiment, the data acquisition system (21) may be at least one of a computer, a smart phone, or any other programmable device that may receive, analyse and process various critical parameters of the sheet metalworking.

The first electrical terminal (2) and the second electrical terminal (5) provided on each of the punch (1) and the support member (4) respectively, are connected to the programmable pulse generator or the pulse width modulator (18). Based on the operation of the press (P), electric current pulses are passed at the working portion (B) of the sheet metal (SM) [shown in FIG. 9]. At the start of the process, the punch (1) with its tip end (TE) is in contact with the sheet metal (SM) at the working portion (B), which is defined as the first position. As the punch (1) is operated further by the press (P), the punch (1) moves from the first position to a second position. As the punch (1) reaches the second position, the sheet metal (SM) has undergone metalworking process [e.g. bending operation, as seen in FIG. 11(*a*), and the sheet metal (SM) has a concave worked portion (T), with a convex outer portion (b) and a middle portion (M).]

In an embodiment, the programmable pulse generator or the pulse width modulator (18) may be programmed to generate various shapes of the electric current pulses. As an example, a rectangular shaped pulse is generated with a predetermined frequency. The predetermined frequency ranges from 1 Hz to 50 Hz. However, the frequencies are only aspects and embodiments disclosed herein are for purposes of illustration and are not intended to be limiting not should be considered as limiting. Similarly, the present document highlights the current application in the range of 0-300 A as disclosed in FIG. 7. However, the present disclosure does not limit the application of electric current within the above mentioned range, but may be used in a wider current range of 0 A to 2000 A.

In an embodiment, the electric current passed through the sheet metal (SM) in pulses, is of a high current, high voltage for metalworking. Due to the high current, high voltage, the load required for sheet metalworking is reduced in comparison with conventional processes.

Exemplary Experimental Results

In an exemplary experimental embodiment, and referring to FIGS. 7 to 10, a C—Mn (Carbon Manganese) steel is used as the material of the sheet metal that is subjected to metalworking, more specifically, bending metalworking operation. The C—Mn steel sheet metal contains 0.045% Carbon and 1.45% Manganese respectively and has a minimum yield strength as 340 MPa.

Based on the bending metalworking, electric current pulses are passed at the working portion and V-bending operation is carried out on the sheet metal. The thermocouple is fixed to the sheet metal to determine temperature of the C—Mn steel sheet metal at the central portion of the sheet metal. The data acquisition system (100), acquires all the data such as load, temperature data and displays to the user.

Figure 8:
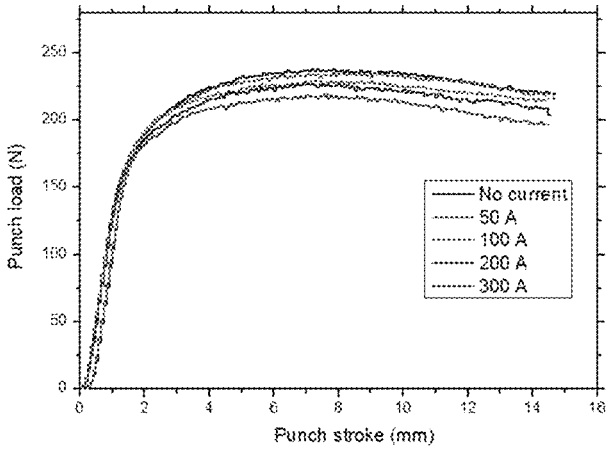
FIG. 8 illustrates a graph showing effect of current on the punch load at 50 Hz frequency, in accordance with an embodiment of the present disclosure.
Figure 9:
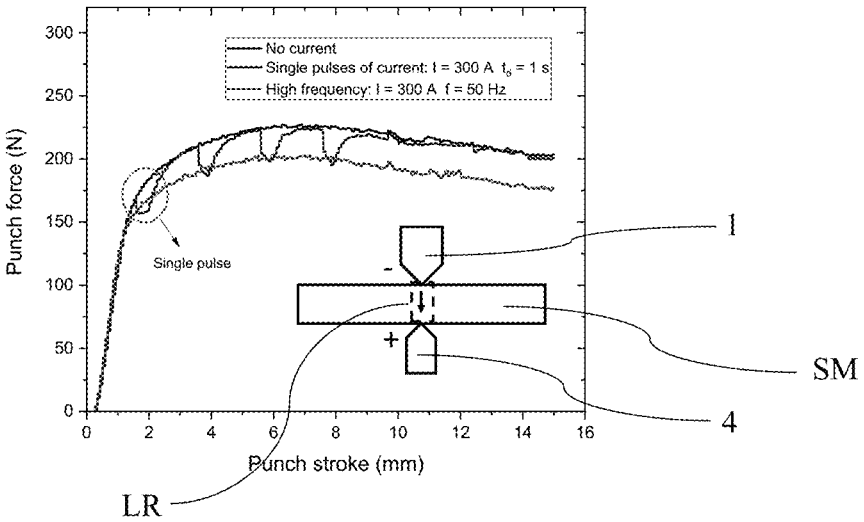
FIG. 9 illustrates a graph showing application of current and current flow in the working portion of the sheet metal, in accordance with an embodiment of the present disclosure.

Based on various experimental iterations with different electric currents and frequencies, the maximum temperature at the centre of the C—Mn steel sheet metal was 129° C. This, experiment disclosed that, no effect of temperature or higher joule heating was imparted on the sheet metal. In an embodiment, the electric current supplied to the sheet metal (SM) has a high current range and a high frequency range. The frequency of the electric current supplied is in the range of 1 Hz to 50 Hz [as shown in FIG. 8]. Also, the electric current supplied to the sheet metal (SM) is in the range of 0 to 300 A.

Similarly, the effect of applying electric current pulses only in the working portion, against applying current along the whole length of sheet metal was carried out.

TABLE 1

Results from Method 1 & 2 with High Frequency Current

| Electric Current application method (1) | Maximum Load drop from base value (N) | Maximum temperature rise (° C.) |
|---|---|---|
| Method 1 (Present disclosure) | 24 | 63 |
| Method 2 (conventional process) | 11 | 56 |

TABLE 2

Results from Method 1 & 2 with Single Pulse Current

| Electric Current application method (1) | Maximum Load drop from base value for each pulse (N) | Maximum temperature rise (° C.) |
|---|---|---|
| Method 1 (Present disclosure) | 10.5, 23, 26, 28 | 44 |
| Method 2 (Conventional process) | No load drop observed | 40 |

Table 1 shows force drop and temperature rise based on the above experiments with continuous electric current pulses application. It is noticed that, the process of the present disclosure, i.e. application of electric current pulses in the working portion achieved more than double load drop compared to the conventional processes [i.e. application of current throughout the length of the sheet metal). The overall, results are about 5% higher load drop in comparison with the process employed in the present disclosure. Simultaneously, the maximum temperatures in comparison with the process employed in the present disclosure and the conventional process was insignificant.

Table 2 shows the results two experimental configurations, with a series of single pulses application and corresponding load drops and maximum temperature rise. The load drop increased from 10.5 N to 28 N with each pulse in the present disclosure. It is also noticed that, the single pulse current application has no effect on the load drop at all in the existing method (1) and it might need very high level of electric current pulses to achieve similar load drops of the order 20 N. In the present disclosure, temperature rises only near to the local deformation zone and other areas of the sheet metal are at room temperature. Whereas in the conventional process, temperature rise is present throughout the sheet metal. Therefore, the present disclosure reduces the amount of joule heating compared to conventional processes and still achieves higher load drops compared to conventional processes.

FIGS. 11*b* to 11*d* illustrate metallurgical effect of electric current pulses and temperature rise during the bending operation. The microstructure comparison with and without the electric pulsing near the bent region is disclosed. There is no significant change in the microstructure between the two cases, emphasising the fact the temperature rise is not significant enough to cause any microstructural changes.

FIG. 12 illustrates a bar graph to investigate the effect of electropulsing on hardness on the sheet metal (SM). From the graph, micro hardness measurements are carried out at five locations along thickness of the metal-worked sheet metal (SM). More specifically, measurements are carried out from a convex side (b) to concave side (T) in the bent region of the sheet metal (SM) [as disclosed in FIG. 11*a*]. It is found that, there is 12% increase in the hardness in bent sheet metal (SM) compared to a base material. Due to strain hardening, the hardness at the bent region has increased. However, there is no significant change in the hardness in bent sheet metal (SM) with electropulsing compared to that of the sheet metal (SM) without electropulsing. Additionally, based on the microstructural study, no major differences are noticed with electropulsing on grain distribution in the sheet metal (SM).

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system (100) having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system (100) having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

REFERRAL NUMERALS

| Referral numerals | Description |
|---|---|
| 100 | System |
| A-A | Common axis |
| B | Working portion |
| DS | Die surface |
| SM | Sheet metal |
| LR | Localized region |
| TE | Tip end of punch and support member |
| P | Press |
| 1 | Punch |
| 2 | First electrical terminal |
| 3 | Die |
| 4 | Support member |
| 5 | Second electrical terminal |
| 6 | Punch holder |
| 7, 7' | Insulation layer |
| 7a | Insulation bush and washer |
| 8 | Slot |
| 9 | Insulation strip |

-continued

| Referral numerals | Description |
|---|---|
| 10 | Power source |
| 11 | Load cell |
| 12 | Adapter |
| 13 | Load cell plate |
| 14 | Die holder |
| 15 | Insulated rods |
| 16 | Mounting holes |
| 17 | Plurality of fillets |
| 18 | Pulse width modulator |
| 19 | Temperature indicator |
| 20 | Thermocouple |
| 21 | Data acquisition system |
| 22 | Resilient member |
| 23 | Plurality of fasteners |

The invention claimed is:

1. A system (100) for sheet metalworking, the system (100) comprising:

a punch (1) connectable to a press (P), wherein the punch (1) is configured with a first electrical terminal (2);

a die (3) configured with a die surface (DS), to support sheet metal (SM); and a support member (4) movably disposed in the die (3), and configured with a base end and a tip end, the tip end proximal to the punch and defining a groove, the support member (4) is provided with a second electrical terminal (5) in the groove; and an insulation strip (9) provided between the support member (4) and the second electrical terminal (5);

wherein, the support member (4) and the punch (1) contact a working portion (B) of the sheet metal (SM) at an axis (A-A) to supply electric current in pulses to a localized region (LR) of the working portion (B) for sheet metalworking, wherein the localized region (LR) is defined by a contact portion of a tip end (TE) of the punch (1) and a tip end (TE) of the support member (4) on either sides of the sheet metal (SM), wherein the electric current passes in the form of pulses from the tip end (TE) of the punch and the tip end (TE) of the support member (4) to the localized region (LR) of the working portion (B) on either sides of the sheet metal (SM).

2. The system (100) as claimed in claim 1, wherein the press (P) comprises a punch holder (6) for housing the punch (1).

3. The system (100) as claimed in claim 2, comprising an insulation layer (7) between the punch holder (6) and the punch (1) to prevent electric conductance.

4. The system (100) as claimed in claim 1, wherein the support member (4) displaces within the die (3) along the axis (A-A) when the punch is operated from a first position to a second position for sheet metalworking.

5. The system (100) as claimed in claim 4, wherein the support member (4) at the first position is in contact at the working portion (B) of the sheet metal (SM) before the sheet metalworking.

6. The system (100) as claimed in claim 4, wherein the support member (4) maintains the contact with the working portion (B) of the sheet metal (SM) in the second position.

7. The system (100) as claimed in claim 1, wherein the support member (4) is biased by a resilient member.

8. The system (100) as claimed in claim 7, wherein the resilient member is a spring.

9. The system (100) as claimed in claim 1, wherein the die (3) comprises a slot (8) for accommodating reciprocal motion of the support member (4) between a first position and a second position.

10. The system (100) as claimed in claim 1, wherein each of the first electrical terminal (2) and the second electrical terminal (5) is connected to at least one of a positive and a negative terminal of a power source (10).

11. The system (100) as claimed in claim 1, wherein the punch (1) is configured with varying tip diameters for sheet metalworking.

12. The system (100) as claimed in claim 1, wherein the sheet metalworking is a plastic deformation process.

13. The system (100) as claimed in claim 12, wherein the plastic deformation process is a bending process.

14. The system (100) as claimed in claim 1, comprises an adapter (12) configured to support load cell plates (13), wherein the load cell plates are configured to house at least one load cell (11) for determining load applied on the punch (1).

15. The system (100) as claimed in claim 14, wherein the adapter (12) with the at least one load cell (11), is secured to the press (P).

16. The system (100) as claimed in claim 1, wherein the support member (4) and the punch (1) contact the working portion (B) of the sheet metal (SM) coaxially along the axis (A-A).

* * * * *